United States Patent [19]

Goncalves

[11] 3,955,716

[45] May 11, 1976

[54] DECORATIVE COVER FOR VALVED END OF PRESSURIZED CONTAINERS

[75] Inventor: Antonin Goncalves, Groslay, France

[73] Assignee: L'Oreal, Paris, France

[22] Filed: Sept. 23, 1974

[21] Appl. No.: 508,696

[30] Foreign Application Priority Data

Nov. 27, 1973 France ..... 73.42137

[52] U.S. Cl. ..... 222/153; 222/182; 215/256; 215/258

[51] Int. Cl.[2] ..... B67B 5/00

[58] Field of Search ..... 222/182, 153; 220/270, 220/276; 215/254, 256, 258

[56] References Cited

UNITED STATES PATENTS

| | | | |
|---|---|---|---|
| 3,037,672 | 6/1962 | Gach | 222/182 |
| 3,235,117 | 2/1966 | Mason | 215/258 X |
| 3,263,867 | 8/1966 | Lehmann | 222/182 |
| 3,474,930 | 10/1969 | Lerner | 222/182 |
| 3,494,510 | 2/1970 | Rahn | 222/153 |

FOREIGN PATENTS OR APPLICATIONS

| | | | |
|---|---|---|---|
| 974,385 | 11/1964 | United Kingdom | 222/182 |

*Primary Examiner*—Drayton E. Hoffman
*Assistant Examiner*—H. Grant Skaggs
*Attorney, Agent, or Firm*—Brisebois & Kruger

[57] ABSTRACT

Decorative cover for valved end of pressurized container comprises inner and outer cylindrical walls. The inner edge of the outer wall terminates in a retaining ring attached to engage over a peripheral abutment on the container and is surmounted by a tear strip. The inner cylindrical wall terminates at its lower end in lugs adapted to snap over another abutment on the container.

3 Claims, 2 Drawing Figures

DECORATIVE COVER FOR VALVED END OF PRESSURIZED CONTAINERS

SUMMARY OF THE INVENTION

Figure 2:
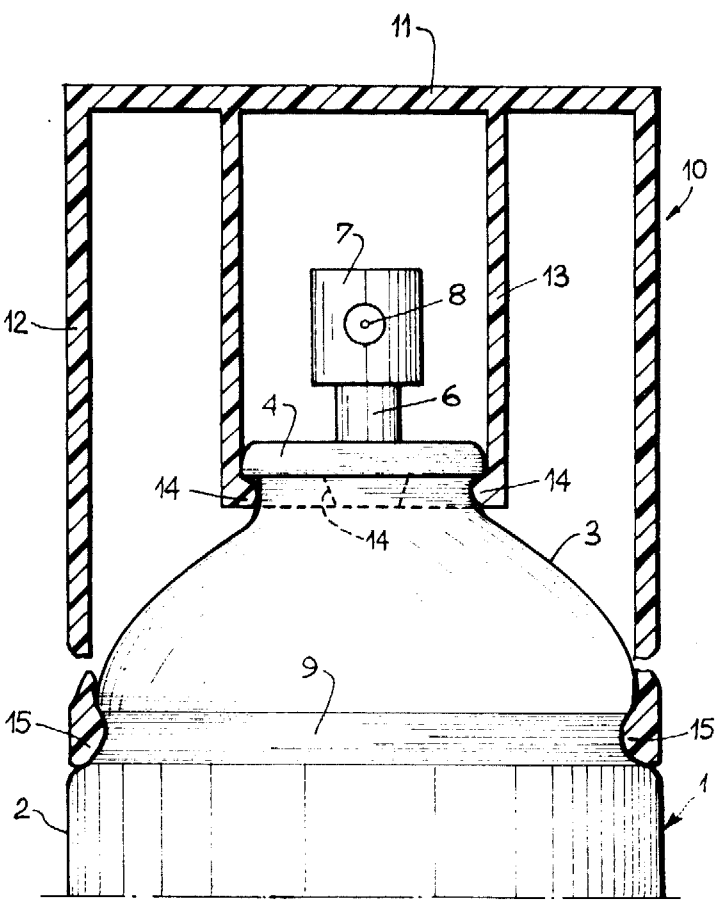

Pressurized containers of the aerosol bomb type are essentially intended for the dispensing of household, cosmetic or perfumery products. These containers comprise a dispensing valve usually positioned at the upper end thereof. This valve is adapted to eject from the container the product to be dispensed which is held therein under pressure, when pressure is exerted on a push-button associated with said valve.

In order to protect the valve and the push-button associated therewith during storage and transportation of such a pressurized container it is conventional to associate therewith a decorative cover adapted to fit onto the container above the valve and to cover said valve. It is obvious that the cover has the additional advantage of improving the appearance of the pressurized container when it is placed on sale and while it is being used by the consumer.

The decorative cover is so constructed that it may be easily attached to some member on the pressurized container. The exact method of attachment is naturally dependent on the construction of the pressurized container and the member on said container to which it is to be attached. To this end the lateral wall of the decorative cover comprises at its lower end at least one snap-fastening means and the pressurized container correspondingly comprises peripheral retaining means such as a groove, flange, or crimped joint in the zone in which the lateral wall of the cap engages the container.

In the particular case in which the pressurized container is made in one piece, that is to say, is formed from a single piece of metal by drawing and swaging, the snap-fastening member of the cover cooperates with a groove formed in the lateral wall of the container in the zone where the cap contacts the container.

When the pressurized container is made in two or three parts connected together by crimped joints, the snap-fastening member of the cover cooperates with one of the crimped joints connecting two parts of the container together, and it preferably cooperates with the crimped joint formed at the connection between the lateral wall and the ogive-shaped upper part conventionally carried by cylindrical containers.

Finally, as an alternative, regardless of the embodiment of the pressurized container, whether formed in one piece or from a number of parts connected together by crimping, the snap-fastening means of the decorative cover may still be so constructed as to cooperate with the crimped joint by means of which a cap carrying the valve is attached to the top of the container. In this specific embodiment the decorative cover comprises a central inner cylinder which is connected to the end of the cover, the bottom of this cylinder being adapted to snap over said crimped joint.

Actually, these methods of attaching a cover to a container only insure the protection of the push-button associated with the valve against involuntary movements which may take place during storage or transportation of the container. In other words, the methods of attachment which have been described do not maintain the contents of the devices inviolable as do sealing strips of the type which prevent the cover snapped on its container from being involuntarily separated from the container which it protects. It is obvious that such a sealing means would have the supplementary advantage of preventing any movement of the push-button and consequently any ejection of the product to be dispensed before the assembly is sold to its subsequent user. The decorative covers mounted on pressurized containers actually on the market do not insure to the consumer that the container sold to him has not been previously used. The present invention is intended to overcome this disadvantage and to this end proposes to provide an assembly comprising a pressurized container associated with a decorative cover equipped with sealing means. If the customer ascertains that this sealing means is present and intact on the cover and its associated container, he will then be certain that the valve of the container which he has acquired has never been actuated and consequently that the container holds all of the product to be dispensed which was originally introduced thereinto by the manufacturer. Conversely, if the consumer notices that the sealing strip has either disappeared or been broken, it is likely that the push-button associated with the valve has been actuated at least once, which permits the prospective customer to refuse to accept the container offered him, since it is not new.

The present invention has accordingly the objective of providing as a new article of manufacture a device comprising a substantially cylindrical container, for example a pressurized container of the aerosol bomb type, made in one or more parts connected together by crimping, for example, and a decorative substantially cylindrical cover adapted to fit onto one end of said container, the axes of the container and the cover being substantially coincident, the container comprising in the zone in which the lateral wall of the cap engages it, peripheral retaining means such as a groove, flange, or crimped joint. This container also comprises at its upper end a crimped joint attaching the valve-carrying cap to the wall of the container. The cap has an inner cylinder, the bottom of which is adapted to cooperate with the crimped joint of the valve-carrying cap to form snap-fastening means for snapping the cover onto the container and is characterized by the fact that the lateral wall of the cap comprises at its lower end a peripheral continuous sealing strip integrated with the retaining means for the container and irreversibly locking the cover on the container, said sealing strip being surmounted by a peripheral tear strip. The base of the central cylinder of the cover is positioned just above the crimped joint attaching the valve-carrying cap to the container before the strip is torn, that is to say, when the cap is fastened to the container by said strip, the height of the tear strip is greater than the space separating the snap fastening member of the cover at the lower end of the central cylinder and the crimped joint of the valve carrying cap before tearing of this strip.

In a preferred embodiment of the invention the cover is formed with two discontinuous peripheral lines which are precut and positioned substantially perpendicular to the axis of said cover, said lines defining the desired height of the strip forming the safety seal of the assembly. These lines are positioned on the lateral wall of the cover between the continuous strip and the top of the cover, preferably in the annular zone adjacent the continuous strip. The discontinuous peripheral lines are associated with a tongue projecting from the external lateral face of the cover, said tongue being fixed to at least one part of the lateral wall of the cap positioned between the two precut lines. The snap-fastening means attaching the cover to the container which is located at the bottom of the central inner cylinder of the cover is formed from several inwardly projecting lugs which are preferably regularly distributed about the inner periphery of the free edge of said cylinder.

Figure 1:
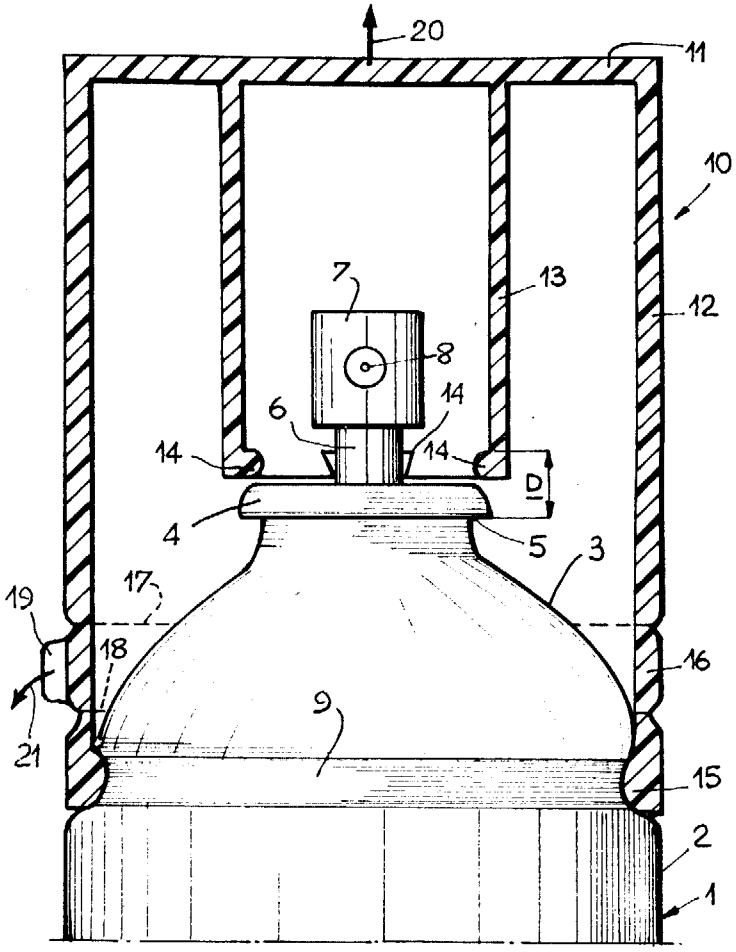

In order that the invention may be better understood, a preferred embodiment thereof will now be described, purely by way of illustration and example, with reference to the accompanying drawing in which:

FIG. 1 shows in axial section the upper part of the container of the device according to the invention, said container being associated with a cover which is irreversibly attached to the lateral wall of the container, said cover being also provided with its sealing means; and FIG. 2 shows in axial section the upper part of the container of FIG. 1 associated with the same cover after tearing of the peripheral strip constituting the sealing means, said cover being snap-fastened onto the container by hooking of the lugs on its central inner cylinder over the crimped joint of the valve-carrying cap.

Referring now to the drawings, it will be seen that reference numeral 1 indicates the entire pressurized container of the aerosol bomb type, which has been made in one piece, for example by drawing and swaging an aluminum disc.

The container 1, which is generally cylindrical in shape, comprises a bottom, not shown, a lateral wall 2 and an upper part 3 in the shape of an ogive. A valve carrying cap 4 is attached to the top of this ogive by a crimped joint 5. Finally, in the central part of the cap 4, is a valve having an outlet tube 6 which carries a push-button 7, the function of which is to permit actuation of the valve and consequently the dispensing of the pressurized product enclosed in the container 1 through a lateral outlet orifice 8.

In the example shown on FIGS. 1 and 2, the container is made in one piece. That is to say its lateral wall 2 and its ogive 3 are formed by drawing from a single disc of aluminum and are connected to each other without any intermediate joint. The wall 2 and the ogive 3 being smooth, a peripheral groove 9 having a depth of about 1 mm and a width of about 2.5 mm is formed where they meet. This groove 9 constitutes the means for retaining a decorative cover 10 which, associated with the pressurized container, is intended to protect the valve and its push-button 7 by covering the entire upper part of said container. It will, of course, be understood that the invention is also applicable to all pressurized containers made in two or three parts connected together by crimped joints. In the most general case each container is then formed in three parts, a bottom, a lateral wall and an ogival upper part connected to each other by crimped joints. The ridge formed by the crimped joint connecting the lateral wall 2 and the ogive 3 then constitutes conventional means for retaining the cover 10 on the container and is strictly equivalent to the retaining means consisting of the groove 9.

The decorative cover 10 has a circular bottom 11 and a cylindrical lateral wall 12 which is connected to the bottom. The cap is preferably made of a molded plastic material such as polyethylene. It is so constructed that the diameter of its cylindrical part is substantially equal to the external diameter of the cylindrical lateral wall 2 of the container 1. That is to say, the axes of symmetry of the container and the cap are coincident when the cover is mounted on the container.

The cover also comprises an inner central cylinder 13, the wall of which is generally parallel to the wall 12. This cylinder is connected to the end 11. Three or four snap-fastening lugs 14 are distributed preferably in a regular manner at 120° or 90° from each other around the bottom and inside the cylinder 13 of the cover in order to form the snap-fastening means for holding said cover on the crimped ridge 5 by means of which the cap 4 is attached to the container 1.

In the part of the lateral wall 12 remote from the end 11 a continuous peripheral retaining ring 15 is formed during molding of the cover. This retaining ring is so positioned at the free end of the cap that it may cooperate with the groove 9 by entering thereinto. The respective heights of the lateral outer wall 12 and the inner central cylinder 13 are such that when the retaining ring 15 is seated inside the groove 9 the snap-fastening lugs 14 lie just above the crimped ridge 5 so that they are not snapped thereover.

The cover 10 also comprises on its lateral wall 12 an inviolability seal consisting of a peripheral tear strip 16 positioned between the retaining ring 15 and the end 11, preferably in the zone adjacent the retaining ring 15. This rupturable strip is defined by two discontinuous lines 17 and 18 which are precut substantially perpendicular to the axis of the cover 10. Finally the inviolability device is associated with a tongue 19 projecting from the wall 12. This tongue is attached at one end to the portion of wall of the cap defined between the precut lines 17 and 18. According to one of the principal characteristics of the cover according to the invention the height of the tear strip 16 defined between the lines 17 and 18 is greater than the interval "D" separating the top of the fastening lugs 14 on the cover 10 and the bottom of the crimped ridge 5 attaching the cap 4 to the container before rupture of the strip 16, that is to say when the cover is mounted on the container by cooperation between the retaining ring 15 and the groove 9.

The cover 10, provided with its inviolability iviolability means, is attached by simple pressure onto the container 1 in an irreversible manner due to penetration of the continuous retaining ring 15 into the groove 9. The seating of the retaining ring inside this groove makes it impossible to remove the cover without deterioration (either rupture or elimination) of the inviolability device. Thus the least traction in the direction 20 exerted voluntarily or involuntarily on the cover 10 to remove it from the container 1 has the effect of breaking the strip 16 before disengagement of the cap is made possible.

Under these conditions, it is obvious to the consumer that the presence of the inviolability strip 16 intact on the cap certifies that the container has remained in its new state, whereas the absence or deterioration of said strip 16 leads to the presumption that some use has been made of the container.

In order to use the assembly according to the invention, that is to say, when the consumer wishes to dispense the product retained under pressure by utilizing the valve, it suffices to pull on the tongue 19, as is schematically by the arrow 21, to rupture the strip 16 by simply tearing it off along the precut lines 17 and 18. After total rupture of the inviolability strip 16 (FIG. 2)

the cover 10 may travel further in the direction of the container and, in particular, it becomes possible to snap the lugs 14 over the crimping ridge 5. Since these lugs are not peripherally continuous it is obvious that by simple deformation of the plastic material forming the central cylinder 13 it is possible to snap the cover on and conversely to remove it from the crimping ring 5 without any deterioration of the cylinder 13 or the lugs 14. Thus the lower end of the cylinder forms a snap-fastening device for holding the cover on the container for all operations involving use of the device after removal of the inviolability device 16.

It will of course be appreciated that the embodiment which has just been described has been given purely by way of illustration and example, and may be modified as to detail without thereby departing from the basic principles of the invention.

What is claimed is:

1. In a device comprising a substantially cylindrical container and a substantially cylindrical cover adapted to be mounted on one end of said container with their axes coincident, said cover having a transverse top closing one end of said cover, and a cylindrical outer wall encircling a shorter cylindrical inner wall radially spaced from said outer wall, each of said cylindrical walls having a first end joined to the same side of said top and a second free end remote from said top, the free end of said outer wall terminating in a retaining ring having a portion which projects radially inward from said outer wall, and said outer wall being formed with a tear strip between said top and retaining ring, said container having two peripheral axially spaced abutments, each having a diameter approximating that of one of said cylindrical cover walls, with one of said abutments positioned and dimensioned to permanently engage said retaining ring, the improvement according to which the free end of said inner cylindrical wall is provided with a plurality of inwardly projecting lugs, each having at least one transverse surface axially spaced from a transverse surface on the other of said abutments, when said tear strip is intact and said retaining ring in engagement with said one abutment, the width of said tear strip axially of said cover being greater than the axial distance between the transverse surfaces of said inwardly projecting lugs and of said other abutment so that said inwardly projecting lugs can be snapped over said other abutment to bring said surfaces into manually separable latching engagement when said tear strip is removed.

2. Device as claimed in claim 1 in which the outer wall of said cover is scored by two discontinuous peripheral lines which are precut substantially perpendicular to the axis of the cap, said lines defining the edges of said tear strip and being positioned between said retaining ring and transverse top adjacent said retaining ring.

3. Device as claimed in claim 2 in which said discontinuous peripheral lines are associated with a tongue projecting from the lateral external face of the cap, said tongue being attached at at least one end to the lateral wall of the cap between said lines.

* * * * *